United States Patent [19]

Brenk

[11] Patent Number: 4,603,978

[45] Date of Patent: Aug. 5, 1986

[54] LAMINATED BASE ELEMENT FOR A WRISTWATCH USING HOT MELT ADHESIVE FOIL

[75] Inventor: Fritz Brenk, Forlenweg, Fed. Rep. of Germany

[73] Assignee: Timex Corporation, Waterbury, Conn.

[21] Appl. No.: 624,171

[22] Filed: Jun. 25, 1984

[30] Foreign Application Priority Data

Apr. 29, 1983 [DE] Fed. Rep. of Germany ..... 3315634

[51] Int. Cl.[4] ..... G04B 37/00

[52] U.S. Cl. ..... 368/317; 368/309

[58] Field of Search ..... 428/285; 368/317, 319, 368/309

[56] References Cited

FOREIGN PATENT DOCUMENTS 2115956 9/1983 United Kingdom ..... 368/317

*Primary Examiner*—Bernard Roskoski

*Attorney, Agent, or Firm*—William C. Crutcher

[57] ABSTRACT

The invention relates to a base element for a wristwatch and in particular a base element in the form of a laminate composed of two plates and a plastic foil. According to the invention, spacer elements, in particular in the form of a non-woven fiber fleece, are embedded in the plastic foil. This will avoid the plastics material being squeezed out laterally along the edges of openings and the like during heat-sealing of the plates with the plastic foil and, at the same time, a high degree of accuracy regarding the thickness of the finished base element will be achieved.

5 Claims, 3 Drawing Figures

Fig. 1
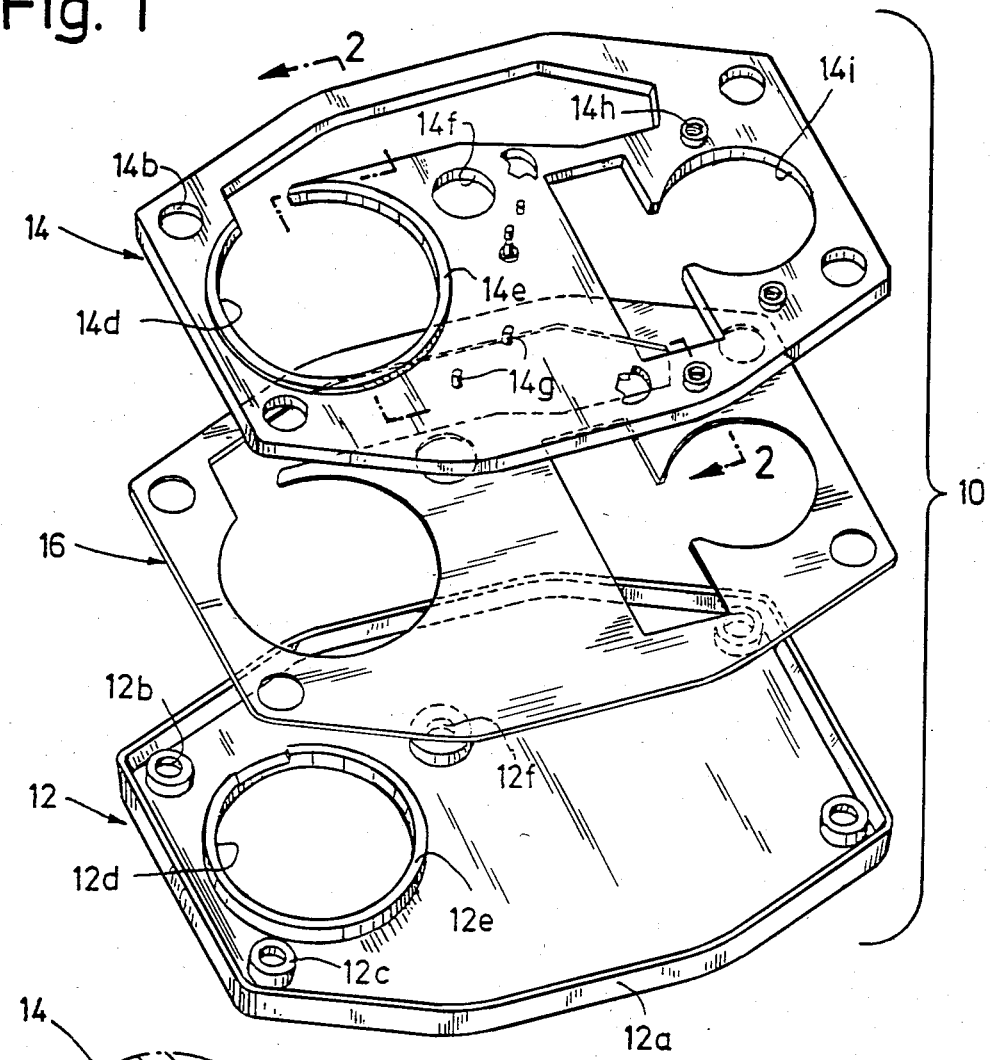
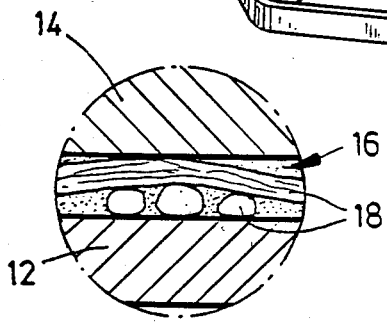
Fig. 3
Fig. 2
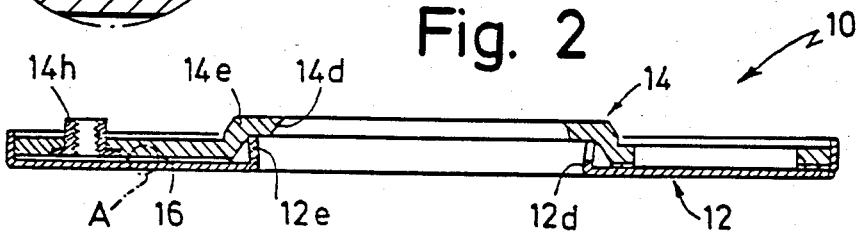

LAMINATED BASE ELEMENT FOR A WRISTWATCH USING HOT MELT ADHESIVE FOIL

BACKGROUND OF THE INVENTION

The invention relates to a base element simultaneously serving the purpose of a movement plate and a caseback for a wristwatch and having two plates bonded together in one piece by a foil of thermoplastic plastics material arranged between them. The invention is an improvement over copending application Ser. No. 457,820 filed Jan. 13, 1983 in the names of Egger et al. and assigned to the present assignee, which utilized a simple thermoplastic foil.

A base element of this type may be produced relatively easily and cheaply but does pose certain problems in mass production in that the thermoplastic material of the foil may, during bonding or heat sealing of the plates, be forced outwards in the areas of openings in the plates if special precautions are not taken. This may later lead to faults or malfunctioning occurring during assembly of additional elements of the watch or during its operation.

Proceeding on the basis of a base element as described in the earlier application, the object underlying the invention is to provide a foil for the bonding process which will guarantee that, during the bonding process carried out at a high temperature and with a certain amount of pressure, the plastics material is not squeezed out of the area between the plates to be bonded into the areas of slits, openings, and the like in a way likely to cause failures.

SUMMARY OF THE INVENTION

In the case of a base element of the type described at the beginning, this object is accomplished according to the invention in that spacer elements are embedded in the thermoplastic plastics material of the foil used for bonding the plates.

The decisive advantage of the inventive base element is the fact that the spacer elements inserted between the plates to be bonded as part of the foil guarantee that a minimum space is maintained between the plates, this space being such that the heated plastics material will no longer be squeezed out through openings and the like. This means that the corresponding recesses are freely available for operation and assembly of the additional watch elements and will not be constricted by protruding plastic beads, in particular along their edge areas. At the same time, dimensional accuracy with regard to the height and thickness of the base element will be kept to very close tolerances and this will facilitate an exact final assembly of the watch.

In development of the invention, the spacer elements are preferably elements of a fiber mat embedded in the thermoplastic plastics material and, in particular, polyester fibers of a non-woven fiber fleece or web. In this case, the adhesive foil may be produced in such a way that the fiber web is first produced and, subsequently, pulverized plastics material is strewn over the web. This will then be treated by hot-calendering between heated calender rollers such that the hollow spaces present in the fiber fleece are filled with plastics material and the resulting surfaces have a sufficient thickness of plastics material for the bonding process.

In advantageous development of the invention, it is also possible to use for production of the foil a thermoplastic plastics material, to which spacer particles of a suitable size are added. These particles may be of an organic or inorganic material and maintain a defined minimum distannce between the plates during bonding due to their more or less uniform support areas on the plates to be bonded.

DRAWINGS

FIG. 1 is a perspective exploded illustration of a preferred embodiment of an inventive base element;

FIG. 2 is a cross section through the base element according to FIG. 1 along the line 2—2; and FIG. 3 is an enlarged section taken from FIG. 2.

DESCRIPTION OF THE PREFERRED EMBODIMENT

In detail, FIG. 1 shows that a base element 10 according to the invention is constructed essentially from three main elements, namely an outer plate 12, an inner plate 14, and a foil 16.

When the watch is fully assembled, the outer plate 12 of the base element 10 forms the outside of the base element or rather an almost conventional caseback and has, in the embodiment shown, an edge 12*a* running around its circumference and facing inwards, in the case of FIG. 1, upwards. In addition, the outer plate 12 has screw openings 12*b* provided in the area of its four corners, each of these being surrounded by a circular, centering collar 12*c*. Moreover, the outer plate 12 has a battery opening 12*d* which is also surrounded by a collar 12*e*. Finally, additional openings, which may also be encircled by a collar, may be provided on the outer plate 12, for example for receiving the actuating elements of operating switches. This type of opening 12*f* is shown in the drawings.

It is clear from the FIGS. 1 and 2 and the foregoing description that it is possible to manufacture the outer plate 12 cheaply as a part stamped from sheet material.

The inner plate 14 may also be stamped from sheet material and is arranged on the inside of the base element when the watch is fully assembled. As shown in particular in FIG. 1, the outer contours of the inner plate 14 correspond to the contours of the outer plate 12 determined by the edge 12*a*. In addition, the inner plate 14 also has openings 14*b*, 14 d, and 14*f* corresponding to the openings 12*b*, 12*d*, and 12*f*, the battery opening 14*d* again being surrounded by an edge 14*e*, as clearly shown in FIG. 2. The two plates 12 and 14 therefore fit exactly into each other; the collar 12*c* surrounding each of the screw openings 12*b* preferably has an outer diameter corresponding to the inner diameter of openings 14*b* so that these collars 12*c* may, as a whole, serve the purpose of centering or positioning the inner plate 14 particularly exactly relative to the outer plate 12.

Apart from the openings already mentioned, the inner plate 14 has additional openings which are not described in detail but serve to receive parts of the watch movement or drive motor and/or printed circuit elements, etc. Furthermore, lugs 14*g* or threaded bushings 14*h* are pressed into the inner plate 14, these elements all being preferably attached before final assembly of the base element 10.

The base element 10 is then completed in such a way that a foil 16 made from a thermoplastic plastics material is placed between the inside of the outer plate 12 and the outside of the inner plate 14. The elements 12 to 16 are then heat-sealed under pressure, preferably in an oven. The plastics foil 16 is, as shown, provided with openings which correspond to the various openings in the inner plate 14. This will, on the one hand, make it easier for elements 12 to 16 to be fitted exactly into each other, while at the same time, the height of the openings, e.g. the opening 14*i* serving to receive watch movement components, corresponds to the full thickness of the plates.

According to the invention, a non-woven fiber fleece or web is embedded in the plastics material of the foil 16, this fleece preferably consisting of polyester fibers 18 which form spacer elements between the plates 12, 14 to be bonded. These spacer elements are at random distances from each other, and the plates are maintained by the spacer elements at a certain minimum distance from each other during bonding or heat-sealing in such a way that it is no longer possible, despite the pressure exerted during the bonding process, for the plastics material to be squeezed out into the openings in the plate 14, for example into openings 14*f* or 14*i*, and later form troublesome plastic beads. This is shown particularly clearly in the enlarged illustration according to FIG. 3.

In a similar way, a predetermined minimum distance will be maintained between the plates 12, 14 to be bonded in that discrete spacer particles are embedded in the plastics material, these particles being made, for example, of metal, glass, or a corresponding plastic which will not substantially soften during heat-sealing.

I claim:

1. A base element of simultaneously serving the purpose of a movement plate and a caseback for a wristwatch, said base element comprising of an outer plate, an inner plate, and an foil of thermoplastic plastics material arranged between them, said plates being bonded together in one piece by said thermoplastic material, said foil having spacer elements embedded in the thermoplastic material of said foil, whereby a minimum distance is defined between said plates by said spacer elements.

2. Base element as defined in claim 1, characterized in that said spacer elements are formed by the elements of a fiber mat embedded in the thermoplastic plastics material.

3. Base element as defined in claim 2, characterized in that said fiber mat comprises a non-woven fiber fleece.

4. Base element as defined in claim 3, characterized in that said fiber fleece is produced from polyester fibers.

5. Base element as defined in claim 1, characterized in that said spacer elements comprises spacer particles embedded in the thermoplastic plastics material of the foil.

* * * * *